US005908127A

United States Patent [19]

Weick et al.

[11] Patent Number: 5,908,127

[45] Date of Patent: Jun. 1, 1999

[54] LOAD BEARING POLYMERIC CONTAINER

[75] Inventors: Robert D. Weick, Sarasota, Fla.; Michael R. Mooney, Wrightsville, Pa.; Richard K. Ogg, Littlestown, Pa.; Raymond A. Pritchett, Jr., York, Pa.

[73] Assignee: Tropicana Products, Inc., Bradenton, Fla.

[21] Appl. No.: 08/961,590

[22] Filed: Oct. 31, 1997

[51] Int. Cl.[6] ..... B65D 90/02

[52] U.S. Cl. ..... 215/373; 220/670; 215/42; 215/382

[58] Field of Search ..... 220/675, 672, 220/670; D9/530, 541, 546, 551, 556; 215/370, 371, 372, 373, 381, 382, 383, 10, 42

[56] References Cited

U.S. PATENT DOCUMENTS

| | | | |
|---|---|---|---|
| D. 93,179 | 6/1934 | Noble | D9/556 |
| D. 115,155 | 6/1939 | D'Addario . | |
| D. 196,752 | 10/1963 | Koenigsberg . | |
| D. 308,484 | 6/1990 | Browton | D9/530 |
| D. 334,236 | 3/1993 | Drounau | D9/552 |
| D. 344,457 | 2/1994 | Prevot et al. . | |
| D. 345,506 | 3/1994 | Potts et al. . | |
| D. 354,000 | 1/1995 | Hoyt . | |
| D. 366,416 | 1/1996 | Semersky . | |
| D. 366,417 | 1/1996 | Semersky . | |
| D. 366,831 | 2/1996 | Semersky et al. . | |
| 3,195,752 | 7/1965 | Cox | 215/382 |
| 3,374,997 | 3/1968 | Stutenreth et al. . | |
| 4,313,545 | 2/1982 | Maeda . | |
| 4,487,048 | 12/1984 | Frei . | |
| 4,538,439 | 9/1985 | Frei . | |
| 4,610,366 | 9/1986 | Estes et al. . | |
| 4,877,141 | 10/1989 | Hayashi et al. . | |
| 5,101,990 | 4/1992 | Krishnakumar et al. . | |
| 5,188,249 | 2/1993 | Cargile . | |
| 5,201,459 | 4/1993 | Bettle, Jr. et al. . | |
| 5,209,372 | 5/1993 | Norwood | 215/383 X |
| 5,269,428 | 12/1993 | Gilbert . | |
| 5,348,217 | 9/1994 | Bettle, Jr. et al. . | |
| 5,350,078 | 9/1994 | Potts et al. . | |
| 5,370,250 | 12/1994 | Gilbert | 215/383 X |
| 5,392,937 | 2/1995 | Prevot et al. . | |
| 5,503,283 | 4/1996 | Semersky . | |
| 5,598,941 | 2/1997 | Semersky et al. . | |
| 5,622,579 | 4/1997 | Tobias . | |

*Primary Examiner*—Gary E. Elkins
*Assistant Examiner*—Tri M. Mai
*Attorney, Agent, or Firm*—Lockwood, Alex, Fitzgibbon & Cummings

[57] ABSTRACT

A load bearing container is provided which is made from a non-glass material and yet possesses the top load column strength of a glass container or bottle. The container includes a diagonally oriented molded ring profile composed of alternatingly outwardly protruding curved sections and inwardly curved channels which have root radii large enough to avoid accordion-like collapsing at the molded ring profile. The container includes a shoulder section having generally opposing edge profiles which are of unequal lengths. The container is suitable for hot-filling and will avoid buckling and deformation during cooling, storage, stacking, transporting, display and use.

33 Claims, 5 Drawing Sheets

LOAD BEARING POLYMERIC CONTAINER

BACKGROUND OF THE INVENTION

This invention generally relates to polymeric containers which are especially well suited to function as recyclable bottles for liquid, flowable or squeezable products. More particularly, the polymeric container is one which exhibits superior top load strength to provide containers which can be filled and stacked one upon the other while in a post-filling location, during transport, during warehouse storage and/or at point-of-purchase display. The containers preferably are also capable of being hot filled with the liquid product in accordance with generally conventional hot filling procedures.

Many liquid, flowable and squeezable products are marketed in consumer quantity packaging. Polymeric containers have heretofore been used in this regard, including those having a polyolefin or a polyester as a primary component. Exemplary bottle materials include polypropylene and polyethylene terephthalate (PET). Whatever material is chosen, it is preferred that it be recyclable.

In certain applications, these types of containers must be stacked vertically, one upon another. Many bottles and the like which are traditionally available and which are made of these types of polymeric materials exhibit limited top load strength. This necessarily minimizes the quantity, most critically the number in a vertical array, of filled bottles or containers. The amount of top load strength required for any such stacking operation will of necessity vary depending upon the particular packaged product and the particular stacking requirements. In some applications, pallets of filled containers are stacked one upon another. It will be appreciated that the filled containers in the bottom row of the bottom pallet will be subjected to substantial top load forces and will buckle or even collapse if the containers do not exhibit adequate column strength.

Hot filling of various beverage and food products is practiced in order to simplify certain aspects of a filling operation. For example, many hot-filled products can be safely filled without requiring special aseptic filling or retort equipment. Hot filling can also eliminate or minimize the need for sterile processing systems. In many cases, the primary components in a hot-fill operation can be a straightforward filling machine and suitable capping equipment. Also, when compared with cold-filled containers or bottles, labeling is typically simplified. With cold-filled products, moisture tends to build up on the outside of the container, thereby complicating the label application task. With a hot-filled operation, moisture buildup is not a typical problem, and labels can be applied with greater ease, efficiency and effectiveness.

Accordingly, it is desirable to provide a container or bottle which is recyclable, able to be stacked safely and, if desired, hot-filled. In addition, it is typically desirable to have a container which is able to be easily handled by a consumer, even when the container is a large, high-volume, multiple serving bottle and the like.

SUMMARY OF THE INVENTION

In accordance with the present invention, important advances in containers are provided. The overall shape of the container of the invention, when combined with certain aspects of the configuration of the container sidewall, provide a polymeric bottle which exhibits superior top load strength, both at ambient temperatures and at refrigerated temperatures. The container has an open top for filling and for subsequent sealing. A body portion of the polymeric container has a shoulder section which depends generally downwardly from the open top, this shoulder section having generally opposing edge profiles which are of unequal lengths. The container is generally oblong in transverse cross-section and has a closed bottom. A molded ring profile is located on at least the shoulder section (or at least part of the shoulder section), and the ring profile has ring sections which are diagonally oriented with respect to the vertical dimension of the body portion. The ring sections lie along different diagonal planes which are spaced generally vertically from each other when the container is in its upright position.

In a preferred aspect of the invention, the molded ring profile is composed of outwardly protruding curved sections alternating with inwardly curved channels which, in combination with other features including the diagonal orientation of the ring profile, contribute to the superior column strength of the container.

It is accordingly a general object of the present invention to provide an improved polymeric container which is easily manufactured from recyclable polymers.

Another object of the present invention is to provide an improved polymeric container which exhibits superior top load strength adequate to withstand stacking of the containers when they are filled with product.

Another object of the present invention is to provide an improved polymeric container for use as a bottle for beverage products, food products and the like which are suited for distribution and sale in polymeric containers having a mouth which is less than the full cross-sectional size of the major transverse cross-section of the container.

Another object of the this invention is to provide an improved polymeric container which exhibits superior column strength while being adapted to be filled with a flowable product which is at a temperature elevated with respect to room temperature and subsequently sealed without buckling upon cool down.

Another object of the present invention is to provide an improved polymeric container having a generally helical ring profile having ring sections which are diagonally oriented with respect to a vertical axis of the container.

Another object of the present invention is to provide a polymeric container having a diagonally oriented ring profile with alternating outwardly curved and inwardly curved portions, such a container possessing top load resistance at ambient, non-heated conditions of at least about 125 pounds.

These and other objects, features and advantages of the present invention will be apparent from and clearly understood through a consideration of the following detailed description.

DESCRIPTION OF THE PREFERRED EMBODIMENTS

Figure 1:
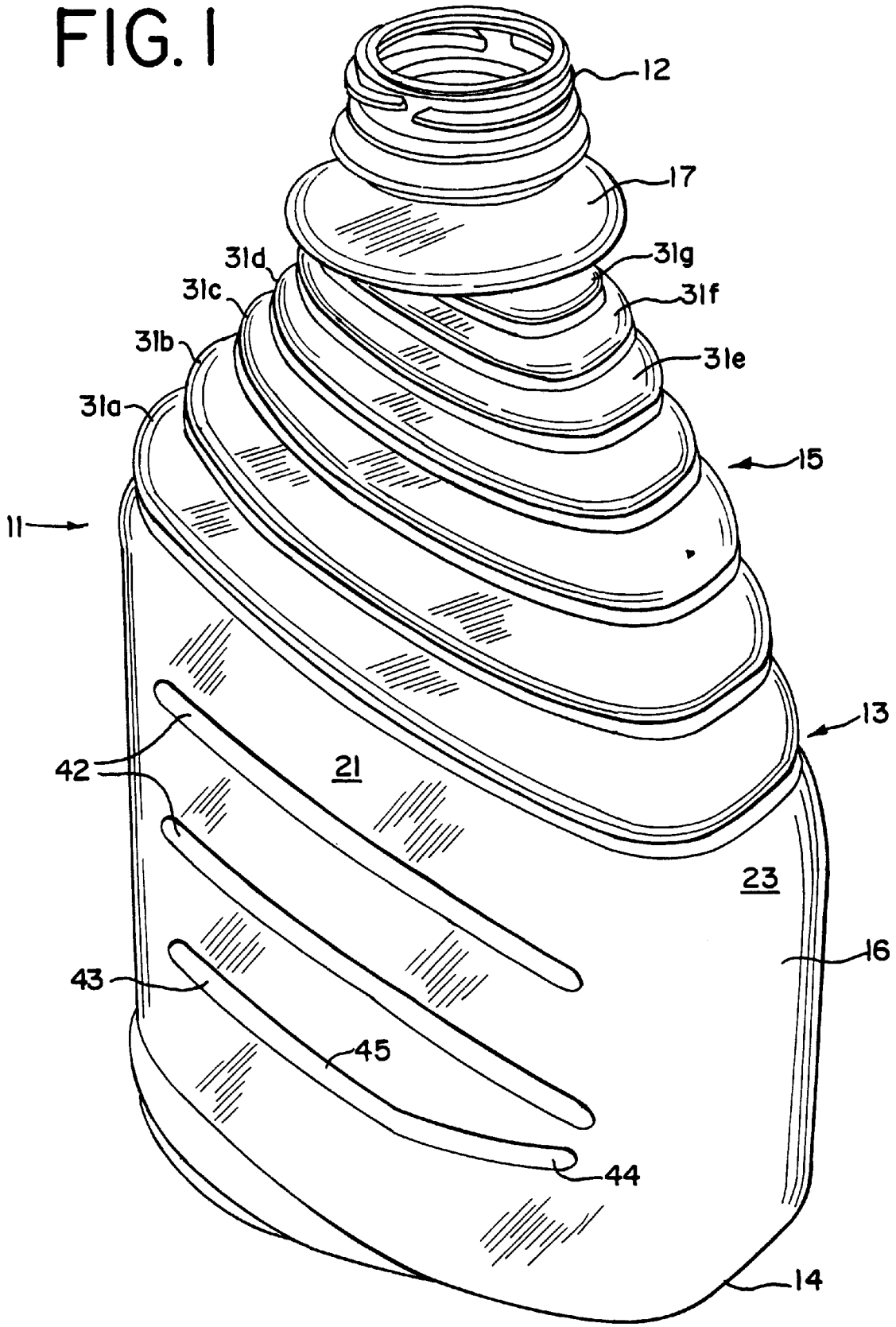
FIG. 1 is a perspective view of a preferred embodiment of a container according to the present invention.

A preferred embodiment of the container according to the present invention is generally illustrated at 11 in FIG. 1. Container or bottle 11 includes an open top 12 which is sized and structured to receive a closure cap (not shown) for sealing the container. Open top 12 allows flowable material to enter into the container and to be removed from the container when desired, typically by the consumer of the contents of the container. The container is especially useful for storing selected quantities of liquid products, including beverages such as fruit juices, water, dairy products, and the like. The container can also be useful for more viscous food products, such as condiments and non-solid food products. The container is especially well-adapted for packaging, storing, transporting, displaying and dispensing products which are hot-filled, such as hot-filled beverages, specifically including fruit juice beverages.

As is generally known, the so-called hot-filled process includes filling containers with flowable product at an elevated temperature, sealing the container with the closure cap, and then allowing the product to cool in the sealed container. As with other containers, container 11 is blow molded from a preform or parison. In the preferred manufacturing arrangement, the parison is preformed by injection molding and then subjected to blow molding procedures, typically incorporating stretch blow molding techniques followed by heat setting. Open top 12 is supported by a body portion, which is generally designated at 13, including a closed bottom 14. Body portion 13 also includes a generally downwardly depending tapering shoulder section, generally designated at 15. A body section 16 is positioned between the closed bottom 14 and the tapering shoulder section 15. A bell 17 can also be provided as shown in the neck area of the container, such being somewhat closely spaced from the open top 12.

Container 11 is generally oblong in transverse cross-section. The preferred cross-section in this regard is that of an ovalized or rounded-off rectangle, as perhaps most readily understood from a consideration of FIG. 5 through FIG. 8. Thus generally defined is a rear panel portion 21, a front panel portion 22, one edge panel portion 23, and another edge panel portion 24. In a typical bottle application, panel portions 21 and 22 include one or more label panel areas. For example, the illustrated container includes a front label panel area 25 and a rear label panel area 26.

Figure 7:
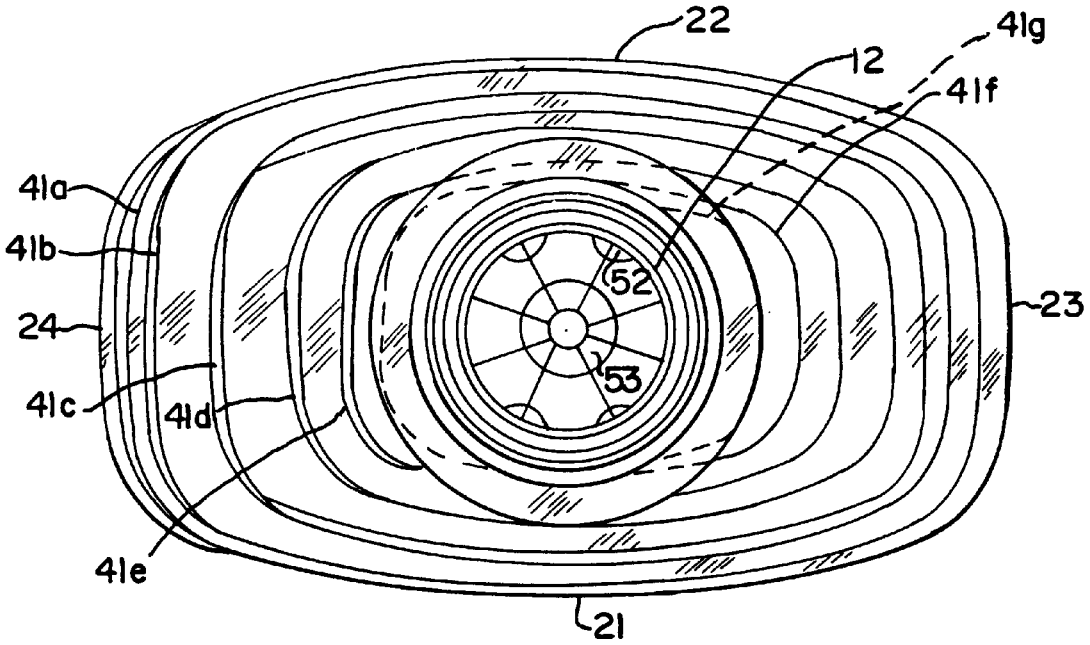
FIG. 7 is a top plan view of an alternative embodiment of the container according to the invention.
Figure 8:
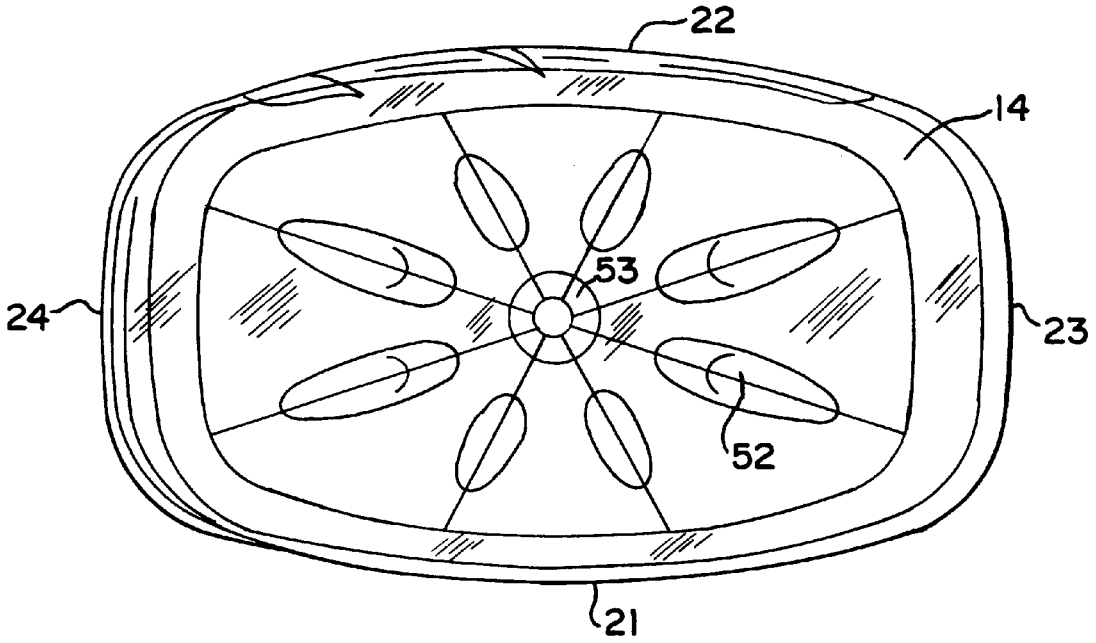
FIG. 8 is a bottom plan view of the container illustrated in FIG. 7.

With more particular reference to the tapering shoulder section 15, a ring profile is molded thereinto. This ring profile is composed of a plurality of ring sections 31*a*, 31*b*, 31*c*, 31*d*, 31*e*, 31*f*, 31*g* being illustrated in the embodiment shown in FIG. 1. In the preferred embodiment, many of these ring sections are full-turn sections which form a continuous spiral-like configuration which generally defines the tapering shoulder section 15. Alternatively, such as shown in FIG. 7 and FIG. 8, the ring sections can be discontinuous annular rings 41*a*, 41*b*, 41*c*, 41*d*, 41*e*, 41*f*, 41*g*. In this alternate embodiment, the rings do not longitudinally flow into each other as is the case for the illustrated preferred embodiment.

Figure 2:
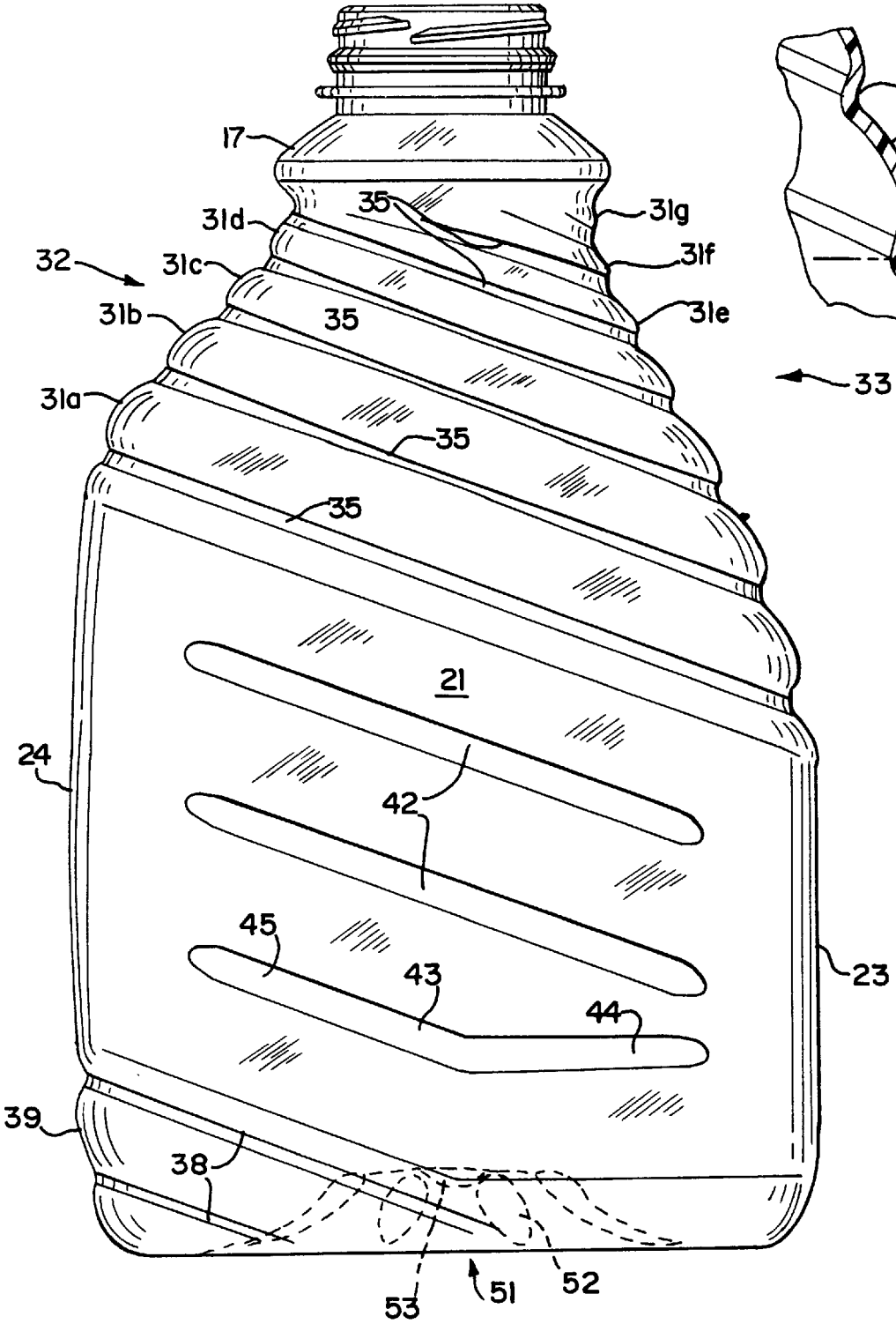
FIG. 2 is a front elevational view of a container according to the present invention as generally shown in FIG. 1.

For either illustrated embodiment, the ring section closest to the body section 16 has the greatest length of all of the ring sections. Generally speaking, the ring sections gradually decrease in length toward the open top 12. It will be appreciated that one or more of the ring sections, particularly the upper ones which are more closely positioned with respect to the open top, need not be full turn rings, but instead are only partial turns, as can be seen in FIG. 1 and FIG. 2, for example.

In accordance with the present invention, the ring sections 31*a* etc., 41*a* etc. are diagonally oriented on the container; that is, the ring sections are neither transversely nor longitudinally positioned on the container. In the illustrated embodiments, the ring sections are oriented at an acute angle with respect to the vertical, such as the vertical axial component or dimension of the container. Consistent with this structure, the tapering shoulder section 15 is asymmetrical. Most notably, the generally opposing edge profiles 32 and 33 of the shoulder are of unequal lengths. As can be seen, for example in FIG. 2, one generally opposing edge profile, designated at 32, is shorter than the other generally opposing edge profile, designated at 33. Correspondingly, the one edge panel portion 23 of the body section 16 has a height which is shorter than that of the other panel portion 24.

In an important aspect of the invention, the container exhibits superior top load strength. With the present invention, filled and capped containers or bottles can be safely stacked one upon another without concern that the bottom bottle(s) will collapse or be deformed. Often, the containers are palletized, by which several bottles are stacked in arrays which take on a generally cubic configuration. On the order of sixty cases, each weighing about 30 pounds, can be loaded onto a pallet. In certain instances, these pallets can be stacked one upon the other.

With the present invention, it has been determined that thus palletized bottles can be stored three pallets high. It will be appreciated that the bottommost of these bottles will be subjected to extraordinary column forces. Glass bottles are able to withstand column forces for product stacked as high as three pallets one on top of the other as generally described above. Traditionally, non-glass or polymeric containers or bottles are not capable of withstanding such high magnitude column forces. Generally speaking, in order to avoid collapsing or buckling under these types of stacked pallet storage situations, the top load resistance of each container or bottle should be at least about 125 pounds when the containers are in an ambient temperature or refrigerated environment, as opposed to the temperature of freshly hot-filled bottles which will exhibit a lower top load resistance.

These top load characteristics are achieved according to the invention. Another top load strength advantage of the present invention is its resistance to deformation at the cap area. Without adequate strength, the neck area can deform or cold flow at points of contact with the closure cap, thereby causing leaks.

Both the material and its wall thickness or weight combine with the configuration of the container in order to determine the top load resistance which will be exhibited by the filled container. It has been determined that, for containers structured in accordance with the preferred embodiment, a minimum top load resistance of 125 pounds is achieved under ambient or refrigerated environment conditions for a bottle stretch blow molded from an injection molded parison of 97 gram PET and exhibiting a Young's Modulus of 88 thousandth's. The wall thicknesses of such a molded bottle ranges between about 0.02 inch and about 0.150 inch, the wall thickness varying at different locations along the structure. In a finite element analysis, such a bottle was determined to safely withstand a top load of 126.7 pounds force at a maximum displacement magnitude of 0.250 inch. In some instances, a top load resistance of least about 150 pounds is desired, and the present invention is capable of achieving top load resistance values of this magnitude.

A bottle made in accordance with the preferred embodiment, in an empty and vented condition, withstood a top load of 133.8 pounds at ambient temperature, with wall thicknesses of the PET ranging between about 0.021 inch and about 0.037 inch. When hot (such as about 175 ° F.), the bottles according to the preferred embodiment withstand a minimum top load of 50 pounds. These bottles were also subjected to and passed standard drop tests from heights of both 3 feet and 4 feet. With the drop load testing, the bottles did not break upon vertical drop onto a concrete or metal surface.

The polymeric materials should have transfer resistance properties so that a product such as a juice beverage can have a shelf life of between about 4 months and about 6 months. During this time, the product should not exhibit degradation of taste, color, loss of oxygen, vitamins, flavors or other product attributes, whether stored in ambient or refrigerated environments. The PET materials as described herein generally satisfy this requirement. Suitable PET materials are available from various manufacturers, including Eastman 9663, Shell 8006, Wellman 61802 and Hoechst-Celanese T86. Preferably, the polymeric molding material includes an ultraviolet filtering component, typically of a type which is blended into the resin, an example being U.V. Block Colormatrix, a typical amount thereof being about 0.10 percent by weight. A typical PET for use in accordance with the invention should have an intrinsic viscosity (IV) which is slightly higher than that used in making contemporary soda bottles of the two liter volume type. Bottle sizes typically range between 1 liter and 2 liters of product capacity.

Figure 2A:
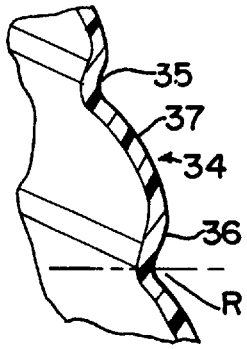
FIG. 2A is a cross-sectional detail view of a portion of FIG. 2.
Figure 3:
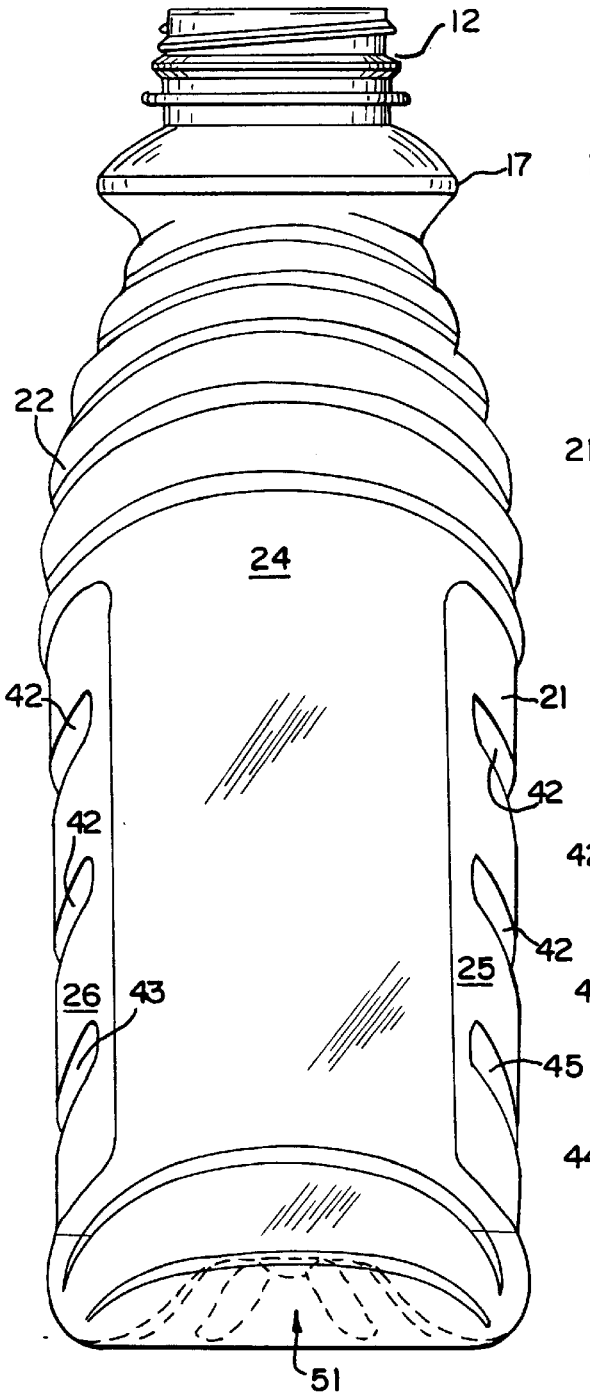
FIG. 3 is a side elevational view of the container depicted in FIG. 2.
Figure 4:
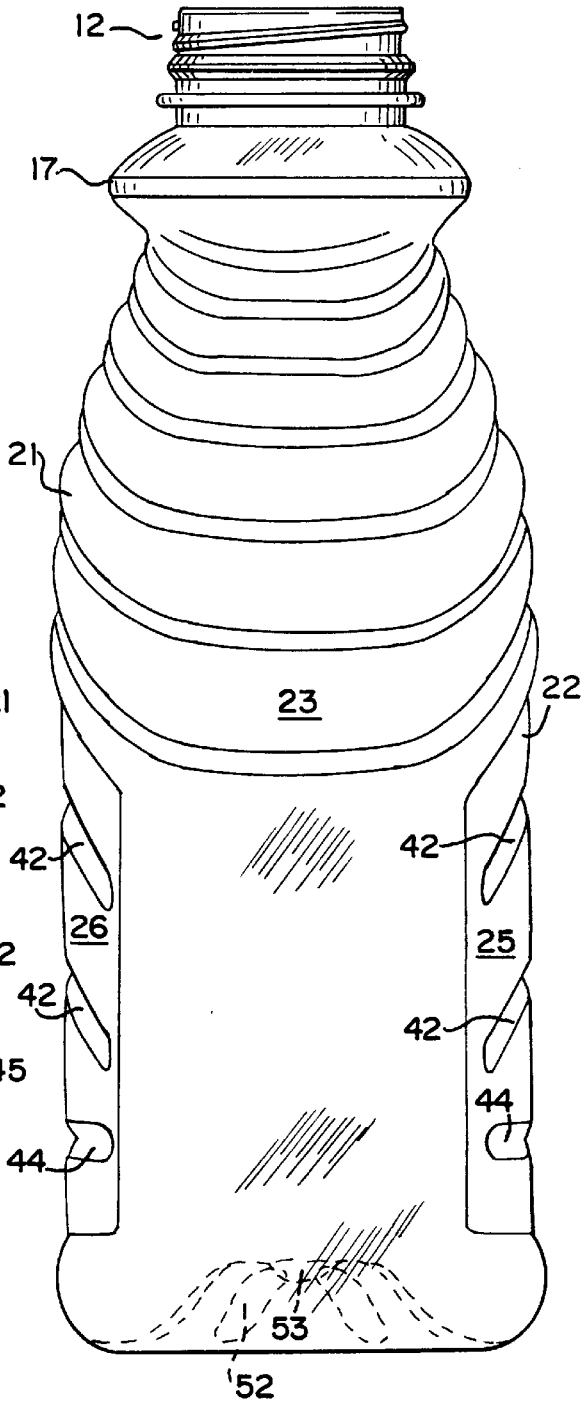
FIG. 4 is an opposite side elevational view of the container of FIG. 2.
Figure 5:
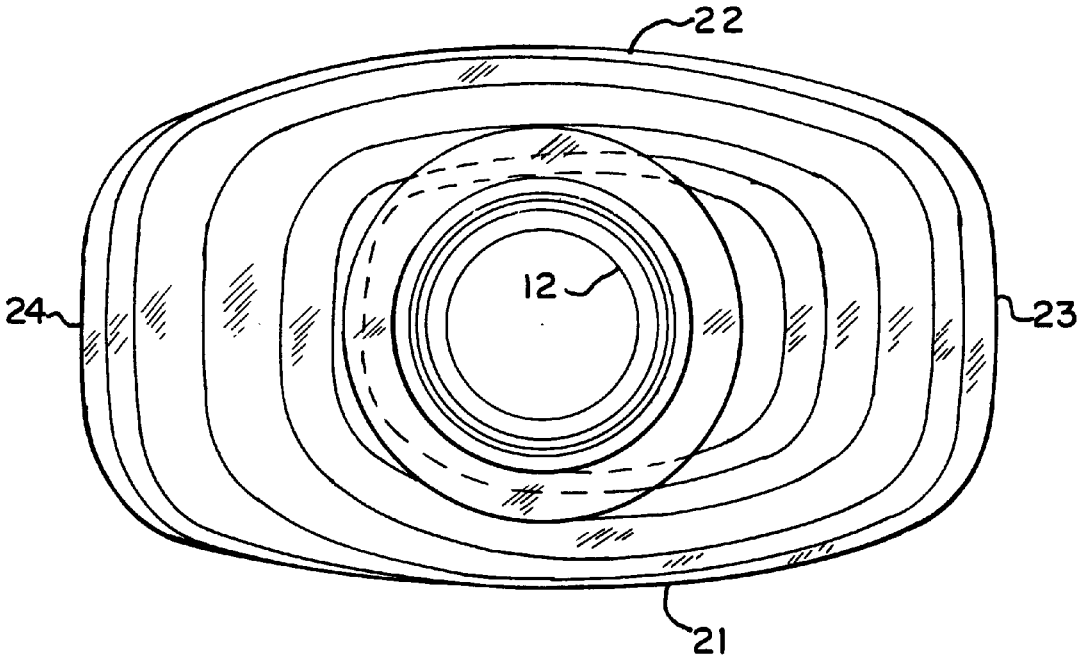
FIG. 5 is a top plan view of a container which is generally illustrated in FIG. 2.
Figure 6:
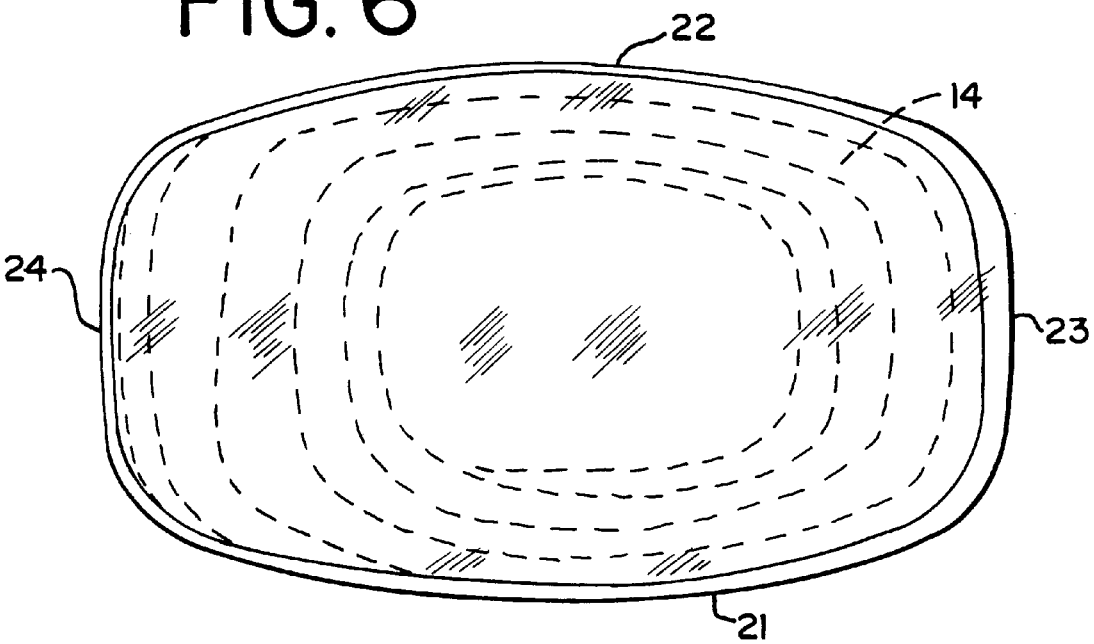
FIG. 6 is a bottom plan view of the container illustrated in FIG. 5.

Referring more specifically to the ring sections, the configuration and structure of these are important to the column strength achieved by the present invention. In addition to the diagonal orientation of the ring sections, the molded ring profile itself provides a particularly load-resistant configuration. As is perhaps best illustrated in FIG. 2A, the ring profile which is presented by the molded profile of the plurality of ring sections is composed of outwardly protruding curved sections 34 alternating with inwardly curved channels 35. Each inwardly curved channel incorporates a root radius "R".

Each root radius designates a channel which is generally arcuate in cross section and which has a radius large enough to avoid a structure which has the appearance and function of a crease which would provide a site at which the bottle could otherwise collapse. It has been determined that root radii of at least about 0.07 inch will enhance top load strength, rather than detract from it.

Generally, the outwardly protruding curved sections 34 need not be strictly arcuate. It is generally preferred that the cross-sectional profile of these protruding curved sections exhibits a curvature whereby a lower portion 36 has a smaller radius than upper portion 37 of the outwardly protruding curved profile. This pattern is generally repeated along the molded ring profile. Downwardly directed forces applied to the open top 12 or a cap thereover will be transmitted down the shoulder portion substantially along this ring profile. The forces travel along the gradually curved shoulder profile while resisting permanent deformation, particularly at the root radii locations, and attendant damage to or collapsing of the container.

The general molded ring profile is again taken up in the illustrated embodiments along a lower section of the body portion 13 of the container. For example, two inwardly curved channels 38 are shown alternatively with at least one outwardly protruding curved section 39. The illustrated channels 38 and curved sections 39 are not full turn structures.

With respect to the preferred intended use of the container in packaging hot-filled products, structures are provided for avoiding excessive buckling which is typically associated with hot-filling operations. Side wall strength can be important in these situations, inasmuch as there is a tendency for a relatively large flat area to suck in as the hot filled product cools and reduces in volume somewhat. One or more ribs or beads are included in this regard. The illustrated preferred embodiment includes two generally parallel diagonal ribs 42 as well as an offset rib 43 having both a generally horizontal leg 44 and diagonal leg 45 which is generally parallel to the diagonal ribs 42. These ribs minimize the need for special handling with respect to vacuum conditions for a hot-filled product.

In addition, the base structure which is visible in FIG. 2, FIG. 3, FIG. 4 and FIG. 8 provides stability to the container so that same can be stacked securely and will not tend to collapse upon being subjected to column loads and hot fill vacuum stresses and strains, as well as being able to remain structurally sound and resist usual handling forces. The illustrated base structure enhances the overall structural integrity of the container. A central concave wall 51 has a plurality of convex dimples 52 which generally surround and radiate from a central convex dimple 53 which has the overall shape of truncated cone. The oblong convex dimples 52 in combination with the central convex dimple 53 assist in uniformly distributing stresses and strains, both during hot-filling and cooling and during storage, transportation, display and use.

It will be understood that the embodiments of the present invention which have been described are illustrative of some of the applications of the principles of the present invention. Numerous modifications may be made by those skilled in the art without departing from the true spirit and scope of the invention.

We claim:

1. A polymeric container which exhibits superior top load strength, comprising:

an open top through which the polymeric container is adapted to be filled;

a body portion having a shoulder section which extends downwardly from said open top, and said body portion has a vertical dimension, is generally oblong in transverse cross-section, and has a closed bottom;

said body portion having a molded ring profile having ring sections at different heights along said vertical dimension and which are diagonally oriented with respect to said vertical dimension of the body portion, said ring profile being located on at least a portion of said shoulder section of the body portion, and said molded ring profile is configured for contributing to the superior top load strength of the polymeric container; and said shoulder section having an overall non-symmetric shape with generally opposing edge profiles which are of unequal lengths, and said molded ring profile having diagonally oriented ring sections is located on said non-symmetric shaped shoulder section.

2. The polymeric container in accordance with claim 1, wherein said ring profile is composed of outwardly protruding curved sections alternating with at least one inwardly curved channel.

3. The polymeric container in accordance with claim 2, wherein said inwardly curved channel has an inwardly curved substantially arcuate profile having a root radius.

4. The polymeric container in accordance with claim 3, wherein said root radius has a value of at least about 0.070 inch.

5. The polymeric container in accordance with claim 2, wherein at least one of said outwardly protruding curved sections has a cross-sectional outwardly curved profile having at least two sections of differing radii values, and wherein one of said sections of the outwardly curved profile is an upper section and another is a lower section, and said lower section has a radius which is less than that of the upper section.

6. The polymeric container in accordance with claim 1, wherein said ring profile is composed of a plurality of outwardly protruding curved sections alternating with a plurality of inwardly curved channels.

7. The polymeric container in accordance with claim 6, wherein each of said inwardly curved channels has a substantially arcuate profile having a root radius of at least about 0.070 inch.

8. The polymeric container in accordance with claim 6, wherein at least one of said outwardly protruding curved sections has a cross-sectional outwardly curved profile having at least two sections of differing radii values.

9. The polymeric container in accordance with claim 8, wherein one of said sections of the outwardly curved profile is an upper section and another is a lower section, and said lower section has a radius which is less than that of the upper section.

10. The polymeric container in accordance with claim 1, wherein at least some of said ring sections on the shoulder section are of unequal annular extent.

11. The polymeric container in accordance with claim 1, wherein said ring sections are continuous with each other so as to impart a generally spiralling orientation to said ring profile.

12. The polymeric container in accordance with claim 11, wherein said ring profile is composed of outwardly protruding curved sections alternating with at least one inwardly curved channel.

13. The polymeric container in accordance with claim 1, wherein at least some of said ring sections are annular rings which are discontinuous with an adjacent ring section.

14. The polymeric container in accordance with claim 13, wherein said ring profile is composed of a plurality of outwardly protruding curved sections alternating with a plurality of inwardly curved channels.

15. The polymeric container in accordance with claim 1, wherein said ring profile is also located on said body section at a location adjacent said closed bottom of the body portion of the polymeric container.

16. The polymeric container in accordance with claim 15, wherein said ring profile is composed of outwardly protruding curved sections alternating with at least one inwardly curved channel.

17. The polymeric container in accordance with claim 1, wherein said body section includes a front panel portion having a front label panel area which is generally parallelogram-shaped and which has a diagonal orientation generally parallel to the diagonal orientation of said molded ring profile.

18. The polymeric container in accordance with claim 17, wherein said front panel portion includes at least one molded diagonal rib.

19. The polymeric container in accordance with claim 18, wherein more than one of said diagonal ribs is provided, and one of said diagonal ribs is an offset rib having a horizontal leg and a diagonal leg.

20. The polymeric container in accordance with claim 1, wherein said closed bottom includes an inwardly disposed central concave wall having a plurality of outwardly disposed convex dimples.

21. The polymeric container in accordance with claim 1, wherein said container is resistant to top loads of at least about 125 pounds when the container is in an ambient temperature or refrigerated environment.

22. A polymeric container which exhibits superior top load strength and which is adapted to be filed with a liquid which is at an elevated temperature above room temperature and subsequently sealed, the container comprising:

an open top through which the polymeric container is adapted to be filled with the liquid;

a body portion having a shoulder section which extends downwardly from said open top, said body portion being generally oblong in transverse cross-section, said body portion having a closed bottom, and said body portion having an axial dimension;

said body portion having a molded ring profile which is diagonally oriented with respect to said axial dimension of the body portion, said molded ring profile being composed of outwardly protruding curved sections alternating with at least one inwardly curved channel, said inwardly curved channel having an inwardly curved substantially arcuate profile; and said shoulder section having an overall non-symmetric shape with generally opposing edge profiles which are of unequal lengths, and said diagonally oriented molded ring profile is located on said non-symmetric shaped shoulder section.

23. The polymeric container in accordance with claim 22, wherein said inwardly curved substantially arcuate profile of the inwardly curved channel has a root radius of at least about 0.070 inch.

24. The polymeric container in accordance with claim 22, wherein said ring sections are continuous with each other so as to impart a generally spiralling orientation to said ring profile.

25. The polymeric container in accordance with claim 22, wherein at least some of said ring sections are annular rings which are discontinuous with an adjacent ring section.

26. The polymeric container in accordance with claim 22, wherein said body section includes a front panel portion having a front label panel area which is generally parallelogram-shaped and which has a diagonal orientation generally parallel to the diagonal orientation of said molded ring profile, and wherein said front panel portion includes at least one molded diagonal rib.

27. The polymeric container in accordance with claim 26, wherein more than one of said diagonal ribs is provided, and one of said diagonal ribs is an offset rib having a horizontal leg and a diagonal leg.

28. The polymeric container in accordance with claim 22, wherein said closed bottom includes an inwardly disposed central concave wall having a plurality of outwardly disposed convex dimples.

29. The polymeric container in accordance with claim 20, wherein at least one of said outwardly protruding curves sections has a cross-sectional outwardly curved profile having at least two sections of differing radii values.

30. The polymeric container in accordance with claim 29, wherein one of said sections of the outwardly curved profile is an upper section and another is a lower section, and said lower section has a radius which is less than that of the upper section.

31. The polymeric container in accordance with claim 22, wherein at least some of said ring sections on the shoulder section are of unequal annular extent.

32. The polymeric container in accordance with claim 22, wherein said ring profile is also located on said body section at a location adjacent said closed bottom of the body portion of the polymeric container.

33.The polymeric container in accordance with claim 22, wherein said container is resistant to top loads of at least about 125 pounds when the container is in an ambient temperature or refrigerated environment.

* * * * *